US005689846A

United States Patent [19]

Cheyne et al.

[11] Patent Number: 5,689,846

[45] Date of Patent: Nov. 25, 1997

[54] LAUNDRY MACHINE WATER FLOW CONTROL

[75] Inventors: Neil Gordon Cheyne; Jonathan David Harwood, both of Auckland, New Zealand

[73] Assignee: Fisher & Paykel Limited, Auckland, New Zealand

[21] Appl. No.: 686,380

[22] Filed: Jul. 25, 1996

[30] Foreign Application Priority Data

Jul. 26, 1995 [NZ] New Zealand ..... 272650

[51] Int. Cl.[6] ..... D06F 33/02; D06F 39/08

[52] U.S. Cl. ..... 008/158; 68/12.05; 68/12.21; 68/207

[58] Field of Search ..... 8/158; 68/12.05, 68/12.21, 12.02, 207; 137/387

[56] References Cited

U.S. PATENT DOCUMENTS 4,184,347 1/1980 Tobita et al. ..... 137/387 X 4,303,406 12/1981 Ross ..... 8/158

4,480,449 11/1984 Getz et al. ..... 68/12.02

5,285,545 2/1994 Payne et al. ..... 68/12.21 X

*Primary Examiner*—Philip R. Coe

*Attorney, Agent, or Firm*—Trexler, Bushnell, Giangiorgi & Blackstone, Ltd.

[57] ABSTRACT

A laundry machine which includes a method for adaptively controlling the flow of water into the laundry machine during the rinse phases of a wash cycle. Water is admitted into the machine through a proportional valve and the flow rate with the valve set at a predetermined degree of opening is calculated. This is compared with a desired flow rate and the degree of opening of the valve is incremented, decremented or left unaltered, depending on whether the calculated flow rate is less than, greater than or substantially the same as the desired flow rate.

4 Claims, 1 Drawing Sheet

LAUNDRY MACHINE WATER FLOW CONTROL

FIELD OF THE INVENTION

This invention relates to laundry machines and in particular to a method of adaptively controlling the flow of water into the machine during the rinse phases of a wash cycle.

PRIOR ART

The goal of water conservation has lead to the introduction of non-immersion rinses in laundry machines. However, where water is sprayed onto clothes loads, it is important to ensure that the rinse water accurately targets the load and is at a flow rate that allows the water to be absorbed into the clothes. One way of ensuring these criteria are met is to optimize the water flow rate during non-immersion rinses.

Due to differing water pressures at differeing laundry machine sites, uncontrolled flow ates into machines can vary from a few liters per minute to tens of liters per minute. While it is convenient to have high flow rates to ensure quick filling of the machine during immersion type fills, a medium flow rate is desired for good spray pattern and soakage during non-immersion rinses. These conflicting requirements can be met by operating at maximum flow rate during immersion fills but restricting the flow rate during non-immersion rinses to an optimum value. This requires a method of measuring flow rate and a proportional inlet valve for controlling flow rate to the desired optimum. However, conventional flow meters are usually too expensive to use in laundry machines.

SUMMARY OF THE INVENTION

It is therefore an object of the present invention to provide a manner of controlling the flow rate of water into a laundry machine which goes some way towards meeting the above requirements while overcoming the above-mentioned difficulties.

Accordingly, in a first aspect the invention consists in a method of adaptively controlling the flow rate of water into a laundry machine to a desired flow rate, said laundry machine having a wash cycle which includes at least one rinse phase, a proportional valve which determines the flow rate of cold water entering the machine and a controller which controls the operation of said machine including the opening and closing of said valve, said controller storing a value which determines the degree of opening of said valve to be used for admitting water into the machine during non-immersion rinse phases, wherein said method comprises:

at an appropriate point in the wash cycle causing the controller to open said valve to an open position which corresponds to said stored value, allowing the machine to fill to or past a predetermined water level, measuring the time taken for the machine to fill to said predetermined level, calculating the flow rate of water passing through said valve from the measured time and the known volume at said predetermined level, comparing the calculated flow rate with said desired flow rate, and updating said stored value which determines the degree of opening of said valve by (a) decrementing said value by a predetermined amount if the calculated rate exceeds the desired rate, or (b) incrementing said value by a predetermined amount if the calculated rate is less than the desired rate, or leaving said stored value unaffected if the calculated rate is substantially the same as the desired rate, In a second aspect the invention consists in a laundry machine having a wash cycle which includes at least one rinse phase, a proportional valve whcih determines the flow rate of cold water entering the machine and a controller which controls the operation of said machine including the opening said closing of said valve, said controller storing a value which determines the degree of opening of said valve to be used for admitting water into the machine during non-immersion rinse phases and storing a program which causes the controller to:

(1) at an appropriate point in the wash cycle open said valve to an open position which corresponds to said stored value, (2) measure the time taken for the machine to fill to a predetermined level, (3) calculate the flow rate of water passing through said valve from the measured time and the known volume at said predetermined level, (4) compare the calculated flow rate with said desired flow rate, and (5) update said stored value which determines the degree of opening of said valve by decrementing said value by a predetermined amount if the calculated rate exceeds the desired rate or by incrementing said value by a predetermined amount if the calculated rate is less than the desired rate, (6) leaving said stored value which determines the degree of opening of said valve unaffected if the calculated rate is substantially the same as the desired rate.

The present inventin provides an adaptive flow control for laundry machines whcih, for each particular machine, progressively achieves a water valve opening which generates optimum flow rate for non-immersion rinses for the site-dependent inlet water pressure supplied to each machine.

BRIEF DESCRIPTION OF THE DRAWINGS

The preferred form of the present invention will now be described with reference to the accompanying drawings in which:

Referring to FIG. 1, a laundry machine is shown diagrammatically comprising a cabinet 1, a tub 2 and a concentric spin basket 3. An agitator 4 is rotatably mounted for oscillatory motion within the spin basket. Water is introduced into tub 2 during the appropriate wash cycle phases through a nozzle 5. The nozzle is preferably formed to produce a spray pattern for non-immersion rinse phases, while allowing water to be dumped at higher flow rate during immersion fills.

Figure 1:
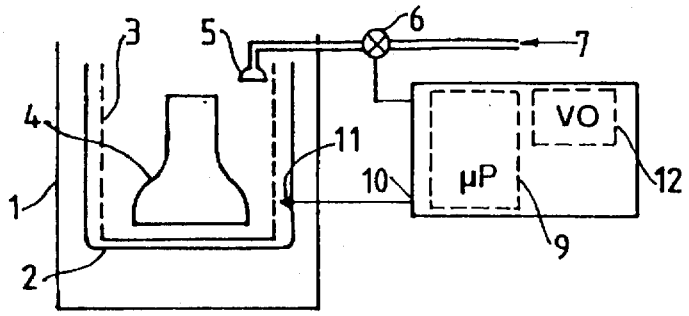
FIG. 1 is a block diagram which shows those laundry machine components which are relevant to the adaptive flow control system of the present invention.

Flow from nozzle 5 is controlled by solenoid valves in the cold and hot water supply lines. In the drawing, for simplicity, only the cold water valve 6 is shown. This solenoid valve should be of the proportional type, that is, a valve where the opening is variable and the degree of opening can be closely controlled by the electrical signal energising it.

The laundry machine operation is determined by a controller 8 which includes a programmed microprocessor 9 loaded with an appropriate control program and look-up tables. For the purposes of the present invention, only those functions of the controller which relate to the control of cold water valve 6 will be described. Thus only a single input port 10 is shown which receices a signal from a water level sensor 11.

According to the present invention, nozzle 5 is desired for an optimum flow rate which produces an accurately defined spray on the target clothes load during non-immersion rinse phases and at that flow rate rinse water is able to soak into the clothes load rather than deflect off it. However, during immersion fill phases, maximum flow rate available from the water supply is desired to minimise wash cycle time. The method by which both of these goals are achieved in the present inventin will now be described.

The optimum flow rate Qd for the particular nozzle configuration is stored in microprocessor memory. In addition, a value 12 which determines the degree of opening of valve 6 during non-immersion rinse phases is stored in memory. Before use of the machine, this value represents simply an estimate of the degree of valve opening which would be required to produce the desired flow rate with an "average" cold water supply pressure. Under the method of the present invention, this value is adaptively adjusted so as to produce the desired flow rate for any site water pressure.

The first step in the method, implemented by a software algorighm in the preferred form, is to measure the actual flow rate which results when valve 6 is opened to the extent determined by flow value 12. The technique used is to perform a "sense fill" where water is admitted into the tube with valve 6 at this degree of valve opening. It is highly desirable that this "sense fill" is part of a fill form some other purpose as it is wasteful of water and increases the wash cycle time if a dedicated sense fill is performed.

Figure 2:
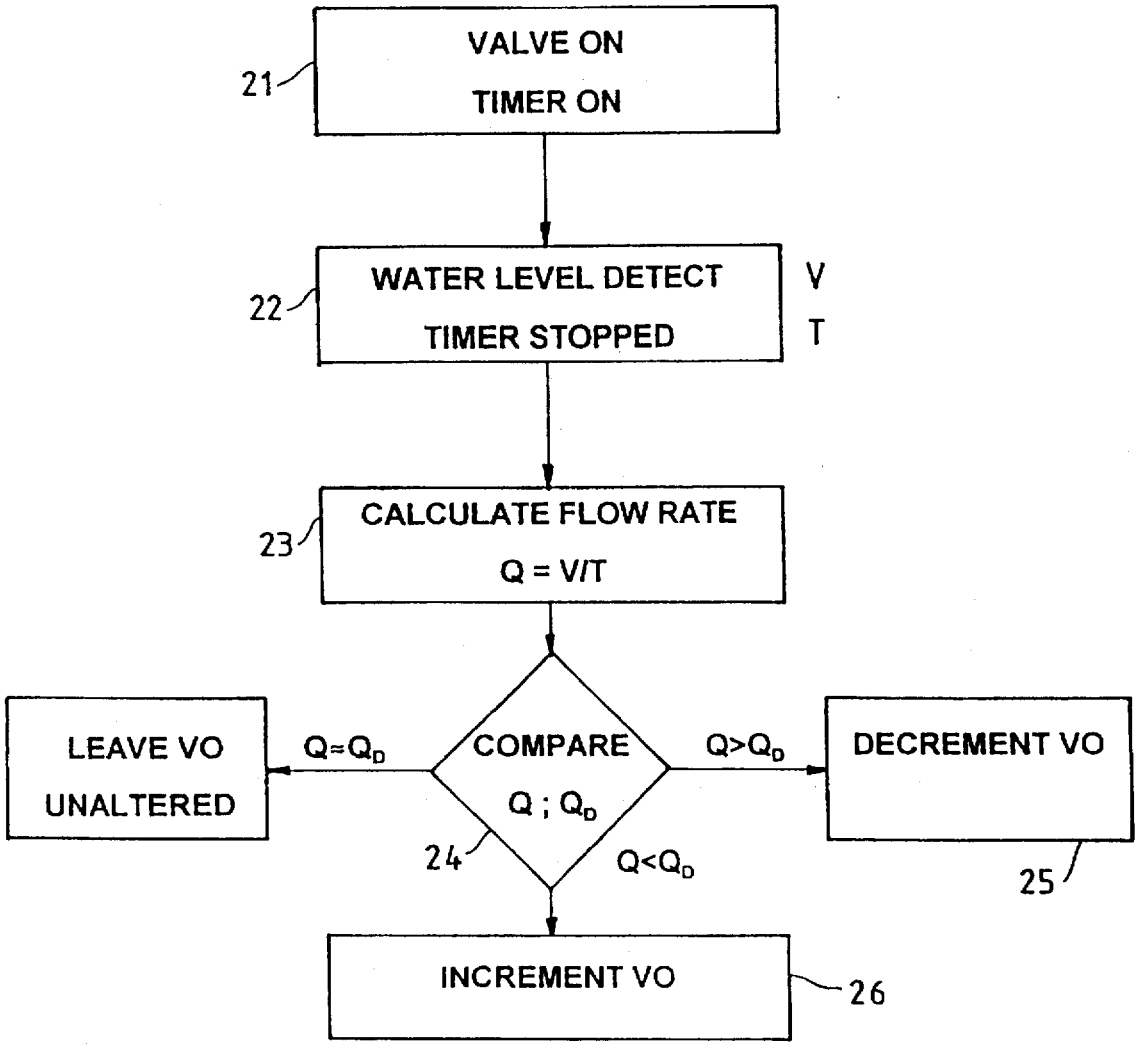
FIG. 2 is a flow chart of the adaptive flow control system.

Water is admitted into the tub—see function block 21, FIG. 2—and a timer initiated. When a predetermined water level is reached, in the preferred form this is determined by a water sensor 11, an input is received at microprocessor port 10 which stops the timer (functions block 22). The time T taken to deliver a volume of water into the tub whose value V is known has now been determined. A stored algorithm enables microprocessor 9 to determine the flow rate Q from time T and the water volume V, (Q=V/T, function block 23.)

The calculated flow rate Q is then compared with the desired flow rate Qd (function block 24). If flow rate Q exceeds flow rate Qd (decision block 24), the valve opening value VO is decremented by a predetermined amount (function block 25). This will result in valve 6 being opened to a reduced degree when it is next opened to admit water for a non-immersion rinse cycle. On the other hand, if calculated flow rate Q is less than desired flow rate Qd, valve opening value VO is incremented by a predetermined amount (function block 26). This will mean that valuve 6 will be opened further when it is next opened for a non-immersion rinse phase. If the calculated flow rate Q is equal to the desired flow rate Qd (within a predetermined degree of tolerance) no updating of valve opening value VO occurs.

If the wash cycle does not provide the opportunity for a further "sense rinse", then the change in the valve opening value is not effected until the next wash cycle—that is, when the laundry machine is next used. Controller 8 stores the updated valve opening value VO between wash cycles. In this way, the valve opening gradually changes over a number of wash cycles until the rinse flow rate is optimised for the inlet water pressure at the machine site.

There will be some circumstances when the valve opening may be substantially different from the opening required for optimum flow resulting in a large difference between the actual flow rate and the desired flow rate. Examples of when this might occur include when a machine is first used at a new site or where changes had occurred in the local water supply. In these situations many wash cycles would pass before the optimum valve opening value had been determine3d when the steps in VO are small. The present invention therefore envisages as a preferred option the use of a gross adjustment to the valve opening value VO when the desired and actual flow rates grossly differ. This requires the controller to run an additional sense fill on first use but has the advantage of quickly compensating for gross errors. The machine will then use the small step adaption techniques to more accurately target the optimum rinse flow rate.

We claim:

1. A method of adaptively controlling the flow rate of water into a laundry machine to a desired flow rate, said laundry machine having a wash cycle which includes at least one rinse phase, a proportional valve which determines the flow rate of cold water entering the machine and a controller which controls the operation of said machine including the opening and closing of said valve, said controller storing a value which determines the degree of opening of said valve to be used for admitting water into the machine during non-immersion rinse phases, wherein said method comprises:

at an appropriate point in the wash cycle causing the controller to open said valve to an open position which corresponds to said stored value, allowing the machine to fill to or past a predetermined water level, measuring the time taken for the machine to fill to said predetermined level, calculating the flow rate of water passing through said valve from the measured time and the known volume at said predetermined level, comparing the calculated flow rate with said desired flow rate, and updating said stored value which determines the degree of opening of said value by (a) decrementing said value by a predetermined amount if the calculated rate exceeds the desired rate, or (b) incrementing said value by a predetermined amount if the calculated rate is less than the desired rate, or (c) leaving said stored value unaffected if the calculated rate is substantially the same as the desired rate.

2. A method as claimed in claim 1 wherein if the comparison between the calculated flow rate and the desired flow rate exceeds a predetermined difference value the size of the increment or decrement to said stored value is increased.

3. A laundry machine having a wash cycle which includes at least one rinse phase, a proportinal valve which determines the flow rate of cold water entering the machine and a controller which controls the operation of said machine including the opening and closing of said valve, said controller storing a value which determines the degree of opening of said valve to be used for admitting water into the machine during non-immersion rinse phases and storing a program which causes the controller to:

(1) at an appropriate point in the wash cycle open said valve to an open position which corresponds to said stored value, (2) measure the time taken for the machine to fill to a predetermined level, (3) calculate the flow rate of water passing through said valve from the measured time and the known volume at said predetermined level, (4) compare the calculated flow rate with said desired flow rate, and (5) update said stored value which determines the degree of opening of said valve by decrementing said value by a predetermined amount if the calculated rate exceeds the desired rate or by incrementing said value by a predetermined amount if the calculated rate is less than the desired rate, (6) leaving said stored value which determines the degree of opening of said valve unaffected if the calculated rate is substantially the same as the desired rate.

4. A laundry machine as claimed in claim 3 wherein if the comparison between the calculated flow rate and the desired flow rate exceeds a predetermined different value the size of the increment or decrement to said stored value is increased.

* * * * *

UNITED STATES PATENT AND TRADEMARK OFFICE

CERTIFICATE OF CORRECTION

PATENT NO. : 5,689,846

DATED : November 25, 1997

INVENTOR(S) : Neil Gordon Cheyne and Jonathan David Harwood

It is certified that error appears in the above-indentified patent and that said Letters Patent is hereby corrected as shown below:

Column 2, Line 36 "inventin" should be --invention --

Column 2, Line 37 "whcih" should be -- which --

Column 3, Line 7 "desired" should be --designed --

Column 3, Line 15 "inventin" should be --invention --

Column 3, Line 27 "algorighm" should be -- algorithm --

Column 3, Line 53 "valuve 6" should be -- valve 6 --

Column 4, Line 7 "determine3d" should be -- determined --

Column 4, Line 53,"proportinal" should be -- proportional --

Signed and Sealed this

Twenty-eighth Day of April, 1998

Bruce Lehman

*Attest:*

BRUCE LEHMAN

*Attesting Officer*

*Commissioner of Patents and Trademarks*